United States Patent [19]

Evans

[11] Patent Number: 4,934,610

[45] Date of Patent: Jun. 19, 1990

[54] METHOD OF COMMINUTING REACTIVE METALS

[75] Inventor: Steven C. Evans, North Ogden, Utah

[73] Assignee: Westinghouse Electric Corp., Pittsburgh, Pa.

[21] Appl. No.: 422,334

[22] Filed: Oct. 16, 1989

[51] Int. Cl.[5] ..... B22F 1/00; B02C 23/18

[52] U.S. Cl. ..... 241/16; 241/18

[58] Field of Search ..... 241/5, 26, 27, DIG. 14, 241/15, 16, 18

[56] References Cited

U.S. PATENT DOCUMENTS 4,369,078 1/1983 Allund ..... 241/18 X 4,579,587 4/1986 Grant et al. ..... 241/15 X

*Primary Examiner*—Timothy V. Eley

*Attorney, Agent, or Firm*—R. A. Stoltz

[57] ABSTRACT

A reactive metal such as zirconium, hafnium, and titanium is subjected to comminution in a closed chamber containing a non-reactive gas modified by the addition of preferably somewhat less than one volume percent of water vapor.

7 Claims, No Drawings

METHOD OF COMMINUTING REACTIVE METALS

BACKGROUND OF THE INVENTION

1. Field of the Invention:

The invention relates to comminution of reactive metals, such as zirconium, hafnium, and titanium, in a non-reactive atmosphere.

2. Description of the Prior Art:

Reactive metals have long been subjected to comminution in so-called "glove chambers" filled with a non-reactive gas, such as argon, and provided with heavy rubber gloves sealed in a wall or walls of the closed chamber and arranged to receive a hand and arm of an attendant standing outside the chamber for permitting such attendant to manipulate apparatus sealed within the chamber.

A disadvantage of past practice has been that the fresh metal surfaces of the resulting particles are chemically very active and inevitably take up some oxygen and some nitrogen, which are regarded as contaminants.

SUMMARY OF THE INVENTION

A principal object in the making of the present invention was to minimize if not eliminate the take-up of oxygen and nitrogen by the fresh surfaces of the comminuted metal.

In accordance with the invention, it has been found, surprisingly, that the addition of a small amount of water vapor to the non-reactive gas in the sealed comminution chamber will greatly reduce the tendency for take-up of oxygen and nitrogen by the fresh surfaces of the reactive metal particles. It should be noted that the non-reactive gas in customary practice prior to the invention has typically contained less than one volume part per million of water vapor.

A presently favored way of adding the water vapor to the non-reactive gas in the sealed comminution chamber is by placing a water-saturated, absorbent carrier, such as a fabric, within the chamber with its surfaces exposed to the non-reactive gas within the chamber, although other ways may be employed, e.g. by placing a wick within the chamber of size and degree of wetness attuned to the amount of vapor found effective for accomplishing the purpose in any particular instance, typically about one percent or less by volume of the amount of non-reactive gas within the chamber. In general, it can be said that it is only necessary to raise the humidity of the atmosphere within the chamber sufficiently to lower the surface energy of the particles of comminuted metal to a point at which the surfaces of such particles of metal are passivated against the pick-up of oxygen and nitrogen.

DETAILED DESCRIPTION OF THE PREFERRED PROCEDURE

The best mode presently contemplated for carrying out the invention in commercial practice (utilizing a comminution chamber whose interior volume is typically about 200 cubic feet) is to place on the floor of the chamber an open stainless steel vessel of about 30 cubic inches capacity containing a water-saturated, cotton wick having a surface area of about one square foot.

Carrying out a comparative test on the basis of this best mode and using identical ingots of zirconium metal (zircaloy containing 98.5% zirconium and 1.5% tin along with small amounts of other metals, such as iron, chromium, and nickel) and identical comminuting procedures within the comminution chamber, in one instance on the basis of only the usual non-reactive gas (argon) within the chamber in accordance with conventional practice and in a second instance on the basis of the addition of water vapor to the extent of somewhat less than one percent by volume of the amount of the non-reactive gas within the chamber, analysis of the comminuted metal particles in the respective chambers showed that those in the second instance, wherein comminution was carried out in a relatively humid atmosphere in accordance with the invention, were lower in oxygen content by approximately 175 parts per million and were also lower in nitrogen content by approximately 10 parts per million.

This showed that practice of the invention lowers the usual oxygen pick-up by the fresh surfaces of the comminuted metal by approximately 30 percent and the usual nitrogen pick-up by somewhat more than 30 percent.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim as my invention:

1. A process of comminuting a reactive metal within a closed chamber filled with a non-reactive gas, comprising adding to said non-reactive gas within the chamber an amount of water vapor effective to passivate fresh surfaces of particles of comminuted metal against pick-up of oxygen and/or nitrogen from said non-reactive atmosphere within said chamber; and carrying out comminution of said reactive metal within the so-modified non-reactive atmosphere within said chamber.

2. A process according to claim 1, wherein the water vapor is added to the non-reactive gas within the chamber by placing within the chamber a water-saturated, absorbent carrier whose surfaces are exposed to said non-reactive gas.

3. A process according to claim 2, wherein the water-saturated, absorbent carrier is fabric.

4. A process according to claim 3, wherein the fabric is a cotton wick having an exposed surface area of about one square foot.

5. A process according to claim 1, wherein the reactive metal is predominantly zirconium.

6. A process according to claim 5, wherein the reactive metal is zircaloy.

7. A process according to claim 6, wherein the non-reactive gas is argon normally containing less than one volume part per million of water vapor.

* * * * *